United States Patent [19]

Suzuki

[11] Patent Number: 4,569,162

[45] Date of Patent: Feb. 11, 1986

[54] APPARATUS FOR TURNING UP AND DOWN SEATS FOR A TELESCOPIC SEATING SYSTEM

[75] Inventor: Fumihiko Suzuki, Musashino, Japan

[73] Assignee: Kabushiki Kaisha Kotobuki, Tokyo, Japan

[21] Appl. No.: 658,522

[22] Filed: Oct. 9, 1984

[30] Foreign Application Priority Data

Nov. 7, 1983 [JP] Japan ..... 58-208698

[51] Int. Cl.[4] ..... E04H 3/12

[52] U.S. Cl. ..... 52/9

[58] Field of Search ..... 52/8-10; 297/331-336, 325

[56] References Cited

U.S. PATENT DOCUMENTS 4,446,659 5/1984 Quigley ..... 52/9

*Primary Examiner*—John E. Murtagh

*Attorney, Agent, or Firm*—Oldham, Oldham & Weber Co.

[57] ABSTRACT

A new apparatus for turning up and down spectators' seats for a telescopic seating system of the type including a plurality of movable platforms which are arranged in tiers is disclosed. The apparatus essentially comprises a frame fixedly mounted on a movable platform, a foot member fixedly secured to the housing of a seat, a stopper link turnably supported on the foot member, an unlocking member turnably supported on the frame and a leaf spring operatively connected to the rear end of the stopper link. The foot member is formed with projections at the rear end part thereof which are adapted to abut against a front nose of the adjacent upper movable platform as the first-mentioned movable platform is displaced forwardly to the extended position. The foot member assumes the upright standing position by turning up on the frame together with the housing of the seat. The foot member is kept in the upright standing state while the stepped portions on the stopper link are engaged to the rear ends of the stopper pieces of the frame. As the movable platform is displaced backwardly to assume the retracted position, the inclined surface on the unlocking member abuts against the front nose of the adjacent upper movable platform whereby the stopper link is released from the engaged state and the foot member is then caused to turn down under the effect of resilient force of the leaf spring.

9 Claims, 8 Drawing Figures

APPARATUS FOR TURNING UP AND DOWN SEATS FOR A TELESCOPIC SEATING SYSTEM

BACKGROUND OF THE INVENTION

1. Field of the Invention

The present invention relates to an apparatus for turning up and down seats for a telescopic seating system and more particularly to an apparatus for turning up folded spectators' seats to the upright standing posture before using the telescopic seating system and turning down them to the horizontally laid posture after completion of using of the same.

2. Description of the Prior Art

In recent years a telescopic seating system including a plurality of movable platforms arranged in tiers is increasingly employed for a building such as gymnasium or the like in order to utilize the floor space more effictively by fully storing all the movable platforms in a cavity formed on the one side wall structure of the building when the system is not in use. The movable platforms in the telescopic seating system are arranged in the form of a so-called doll tier stand such that the foremost movable platform is located at the lowermost position and the rearmost movable platform is located at the highest position when the system is in use while all the movable platforms assume their extended position. They are operatively connected to one another and they can assume the extended position in the doll tier stand-shaped condifuration by starting forward movement with the lowermost movable platform. On the other hand, when operation of the system is completed, they are stored in the cavity of the building without any projection from the wall surface by starting rearward movement with the lowermost movable platform.

In the conventional telescopic seating system all seats are manually turned up one by one by when the system is in use and thereby the movable platforms assume their extended position and after completion of operation of the system they are manually turned down one by one with the aid of personnels in the building before the movable platforms are stored.

Accordingly, a large number of man-hours are required for turning up and down seats, resulting in the telescopic seating system being operated at an increased cost. This means that a building such as gymnasium or the like cannot be used economically.

To obviate the foregoing problem there was proposed an improved telescopic seating system as dislosed in U.S. Pat. No. 4,155,202. This improved telescopic seating system is constructed such that all components constituting a seat are automatically folded and unfolded without any necessity for manual handling performed by personnels in the building. However, it has been pointed out that the improved telescopic seating system has drawbacks that it is comlicated in structure and therefore it can be installed at an expansive cost.

SUMMARY OF THE INVENTION

Thus, the present invention has been made with the foregoing background in mind.

It is an object of the invention to provide an apparatus for turning up and down seats for a telescopic seating system of the early-mentioned type which is entirely free from the drawbacks inherent to the conventional ones.

It is other object of the invention to provide an apparatus for turning up and down seats for a telescopic seating system of the early-mentioned type which is simple in structure and can be manufactured at an inexpensive cost.

It is another object of the invention to provide an apparatus for turning up and down seats for a telescopic seating system of the early-mentioned type which assures that it is operated reliably without any occurrence of mechanical trouble.

To accomplish the above objects there is proposed according to the invention an apparatus for turning up and down spectators' seats for a telescopic seating system of the type including a plurality of movable platforms which are arranged in tiers essentially comprising a frame having a foot member and an unlocking member turnably carried thereon, the frame including an opposing pair of stopper pieces which have a slot formed therebetween so as to allow the foot member to be turnably held therein, the foot member being formed with projections at the rear end thereof which are adapted to abut against a front nose fixedly secured to the adjacent upper movable platform, a stopper link of which one end is pivotally connected to the foot member and of which other end is operatively connected to spring means, the stopper link being formed with raised portions adapted to be engaged to the rear ends of the stopper pieces of the frame, the spring means being operatively connected to the stopper link at the upper end thereof and having resiliency which is effective for turning up the foot member toward the upright standing posture when the projections of the foot member are disengaged from the front nose of the adjacent upper movable platform, and the unlocking member including an inclined surface and a depressing plate, the inclined surface being adapted to abut against the front nose of the adjacent upper movable platform and the depressing plate serving to depress the stepped portions of the stopper link.

The frame is fixedly mounted on a movable platform and its rear side is fixedly secured to a stanchion which stands upright on the movable platform.

Further, the foot member is formed with a cutout at which a housing of the seat is fixedly connected to the foot member.

Projections on the rear end of the foot member abut against the front nose of the adjacent upper movable platform when the first mentioned movable platform is displaced forwardly to assume the extended position.

An inclined surface of the unlocking member abuts against the front nose of the adjacent upper movable platform when the first-mentioned movable platform is displaced backwardly to assume the retracted position where the latter is stored in a cavity on the side wall structure of the building.

In a preferred embodiment of the invention the resilient means is designed in the form of a leaf spring and functions such that before it assumes the neutral operative position, a moment is generated which is effective for turning down the foot member with a moment due to dead weight of the latter added thereto and after the neutral operative position is reached, a moment is generated which is effective for turning up the foot member against the moment due to the dead weight of the latter.

The foot member is kept in the locked state while the stepped portion of the stopper link are engaged to the rear ends of the stopper pieces of the frame.

Further, the foot member is released from the locked state when a depressing plate of the unlocking member depresses the raised portions of the stopper link.

Other objects, features and advantages of the invention will become more clearly apparent from reading of the following description which has been prepared in conjunction of the accompanying drawings.

BRIEF DESCRIPTION OF THE DRAWINGS

The accompanying drawings will be briefly described below.

DETAILED DESCRIPTION OF THE PREFERRED EMBODIMENT

Now, the present invention will be described in a greater detail hereunder with reference to the accompanying drawings which illustrate a preferred embodiment thereof.

First, description will be made as to a telescopic seating system for which an apparatus for turning up and down according to the invention is employed. As is apparent from FIG. 1 which is a fragmental side view of the system, the whole telescopic seating system as identified by reference letter A is fully extended in the forward direction while slidably moving on the floor D, when it is in use. Specifically, a plurality of movable platforms 2 with a number of spectator's seat C mounted thereon are successively drawn with the aid of rollers 3 adapted to roll on the floor D in such a manner that one platform is operatively connected to another one which is located behind the former. Thus, when the system A assumes the extended position, it looks like a tier doll stand. On the other hand, when it is out of use, it is retracted to the initial position by way of the reverse steps to those as mentioned above. Specifically, the one movable platform thrusts the other one to move in the backward direction together with the latter until the whole system is completely stored in a cavity which is formed in the side wall structure of the building. Thus, when the system A assumes the storage position, no movable platform is projected forwardly of the side wall surface of the building.

Figure 1:
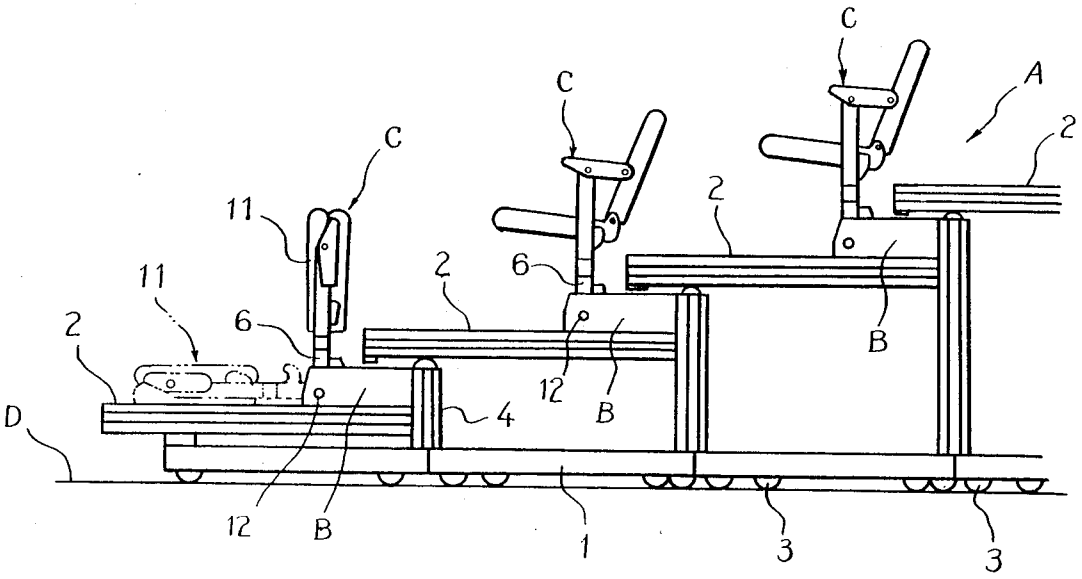
FIG. 1 is a fragmental side view of the telescopic seating system with spectators' seats mounted thereon for which the apparatus of the invention is employed.

As illustrated in FIG. 1, each of the movable platforms 2 constituting the system A is provided with an apparatus B for turning up and down seats according to the invention at the position located in the proximity of a stanchion 4. Since one apparatus B is provided for each of seats C on each of the platforms 2, a plurality of apparatuses B are arranged in tiers in the spaced relation with the same distance kept between adjacent ones as that of row of seats C, when the system S assumes the extended position.

Figure 2:
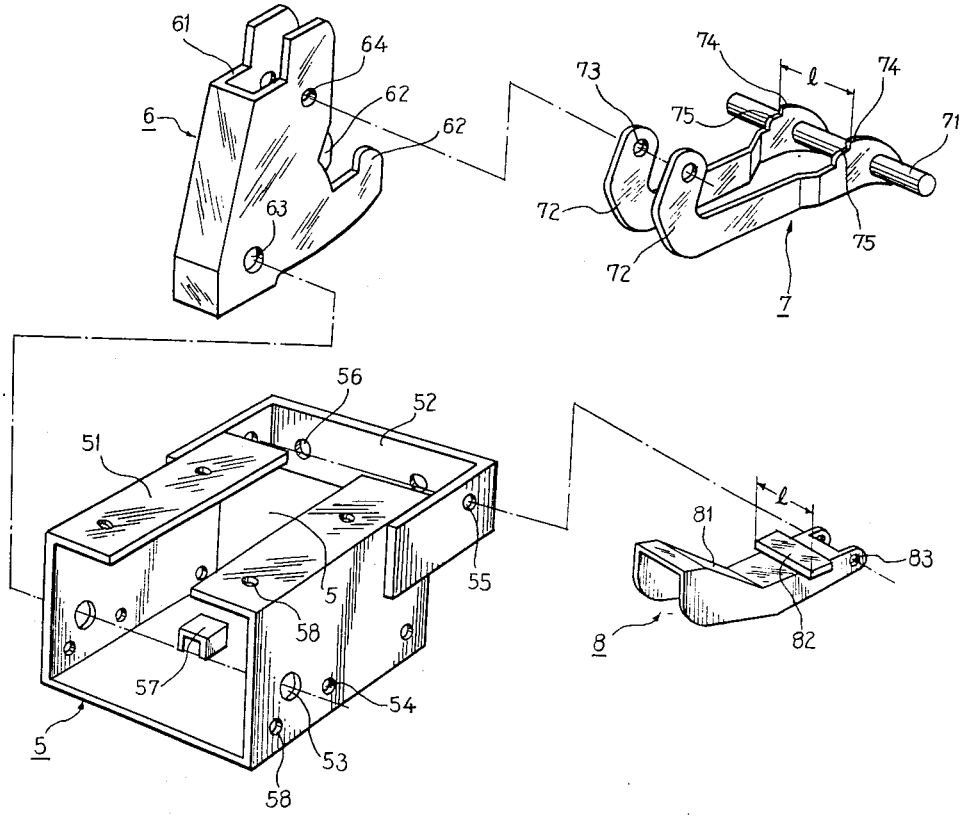
FIG. 2 is a perspective view of four main components constituting the apparatus of the invention, shown in the disassembled state.

Next, description will be made below as to how the apparatus B for turning up and down spectators' seats (hereinafter referred to simply as apparatus) is constructed. As illustrated in FIG. 2, the apparatus B essentially comprises a frame 5, a foot member 6, a stopper link 7 and an unlocking member 8. The frame 5 is formed in the substantially U-shaped configuration as seen from the front by bending a sheet of metallic plate having a predetermined width while a slot 50 is provided at the upper part of the frame 5 in the longitudinal direction. The width of the slot 50 is so determined that a pair of parallel extending projections 72 of the stopper link 7 with the upper part of the foot member 6 located therebetween are loosely fitted through the slot 50. Further, the frame 5 is formed with an opposing pair of stopper pieces 51 at the upper part thereof with the slot 50 being located therebetween so that raised portion 74 on the stopper link 7 are brought in sliding contact with the bottom surface of the stopper pieces 51 when the platform 2 initiates its forward movement. An inverted U-shaped projection piece 52 is fixedly secured to both the side walls of the frame 5 by welding operation in such a manner that its upper end edge is located flush with the upper surface of the pair of stopper pieces 51. Further, support holes 53 having the same diameter as that of support holes 63 of the foot member 6 are formed at the fore part of the frame 5 in such a manner that the former are located in horizontal alignment with the latter when the foot member 5 is turnably mounted on the frame 5. Pin holes 54 are formed on both the side walls of the frame 5 at the position located behind the support holes 53 as seen in the drawing so that one end of each of leaf springs 9 to be described later is engaged to the pin hole 54. In addition pin holes 55 having the same diameter as that of pin holes 83 of the unlocking member 8 are formed on both the side parts of the projection piece 52 at the position located behind the side walls of the frame 5 in such a manner that the former are located in horizontal alignment with the latter when the unlocking member 8 is turnably mounted on the frame 5. Incidentally, to attach the frame 5 to the top part of the stanchion 4 on the movable platform 2, two bolting holes 56 are formed on the rear part of the projection piece 52. Further, an inverted U-shaped stopper receiver 57 is fixedly secured to the upper surface of the bottom part of frame 5 at the substantially central position by welding operation. A certain number of threaded holes 58 are provided on the stopper pieces 51 and the side walls of the frame 5 so as to allow the latter to be fixedly mounted on the movable platform 2.

As is apparent from the drawings, the foot member 6 is designed in the substantially U-shaped configuration as seen from the above of which width is determined so as to allow it to be inserted through the slot 50 of the frame 5 while a pair of parallel extending projection pieces 72 constituting the stopper link 7 are located outwardly of both the side walls of the foot member 6. Further, the foot member 6 is formed with a cutout 11 at the upper front end thereof at which a joint member 11*a* attached to the bottom of a housing 11 to be described later is fixedly connected to the foot member 6. In the vicinity of the cutout 61 are provided joint holes 64 which assume the position in horizontal alignment with joint holes 73 on the parallel extending projection pieces 72 of the stopper link 7. Further, on both the side walls of the foot member 6 at the lower position are provided support holes 63 which assume the position in horizontal alignment with support holes 53 on the frame 5. The foot member 6 includes a pair of upwardly extending projections 62 which are protruded rearwardly of both the side walls of the foot member 6 in the form of an extension. The projections 62 are adapted to come in abutment against a front nose 2*a* of the adjacent upper movable platform 2 when a row of seats are turned up so that the foot member 5 stands upright.

On the other hand, the stopper link 7 includes a spring support rod 71 of which length is so determined that it moves freely in the space as defined between both the side walls of the frame 5 and the base portions of the parallel extending projection pieces 72 are fixedly fitted onto the spring support rod 71 in the spaced relation by a distance of l.

As will be best seen in FIG. 2, the foremost end part of each of the projection pieces 72 is bent upwardly at a substantially right angle to stand upright and the joint holes 73 adapted to assume the position in horizontal alignment with the joint holes 64 of the foot member 7 are provided at the upper part of the upwardly bent portions. The pair of parallel extending projection pieces 72 are spaced widely one from another at the rear part thereof and raised portions 74 are formed at the upper part of the rearmost end thereof at the position where the spring support rod 71 is fixedly secured to the projection pieces 72. A stepped portion 75 is formed at the position located forwardly of the raised portion 74 by cutting a part of the latter in such a manner that it comes in engagement to the rearmost end of each of the stopper pieces 51 on the frame 5.

Next, the unlocking member 8 is constructed as described below. The unlocking member 8 is designed in the bent configuration of which width is so determined that it is inserted into the space as defined between both the parallel extending projection pieces 72 of the stopper link 7 and moreover it has an inclined surface 81 at the fore part thereof which extends at a certain upward inclination angle. The rearmost end of the unlocking member 8 is designed in the U-shaped configuration as seen from the above and pin holes 83 having the same diameter as that of pin holes 55 on the frame 5 are formed on both the side walls of the unlocking member 8. When the unlocking member 8 is turnably mounted on the frame 5, the pin holes 83 are located in horizontal alignment with the pin holes 55. In the proximity of the pin holes 83 is disposed a depressing plate 82 having a length of l which is adapted to come in contact with the raised portions 74 of the stopper link 7 when it turns in the anticlockwise direction as seen in the drawings. The depressing plate 82 extends at a right angle relative to the longitudinal direction of the unlocking member 8 and is fixedly secured to the latter by welding operation.

The frame 5, the foot member 6, the stopper link 7 and the unlocking member 8 as constructed in the above-described manner are assembled by way of the following steps. As illustrated in FIGS. 3 to 6, the stopper link 7 is first fitted to the foot member 6 in such a manner that the pair of parallel extending projection pieces 72 are located outwardly of the side walls of the foot member 6 with a close clearance kept therebetween. A joint pin 15 is then inserted through the holes 64 of the foot member 6 and the holes of the stopper link 7 so that the foot member 6 turns freely about the joint pin 15. After the foot member 6 is assembled with the stopper link 7 in that way, it is loosely inserted through the slot 50 of the frame 5 and a support shaft 12 is extended through the holes 63 of the foot member 6 and the holes 53 of the frame 5 whereby the foot member 6 turns freely forward and backward about the support shaft 5 together with the stopper link 7 carried on the latter. Next, the unlocking member 8 is housed in the frame 5 assembled with the foot member 6 and the stopper link 7 in that way and a joint pin 14 is extended through the holes 55 of the frame 5 and the holes 83 of the unlocking member 8. It should be noted that the unlocking member 8 is held with the aid of a support member which is not shown in the drawing but operatively associated with the joint pin 14 so as not to allow the foremost end of the inclined surface 81 to be lowered below the upper surface of the stopper pieces 51 of the frame 5. Thus, the frame 5 which has assembled with the foot member 6, the stopper link 7 and the unlocking member 8 in the space as defined by the slot 50 and the projection piece 52 is fixedly secured to the top of the stanchion 4 by inserting bolts through the holes 56 of the projection piece 52 and then tightening nuts.

Figure 5:
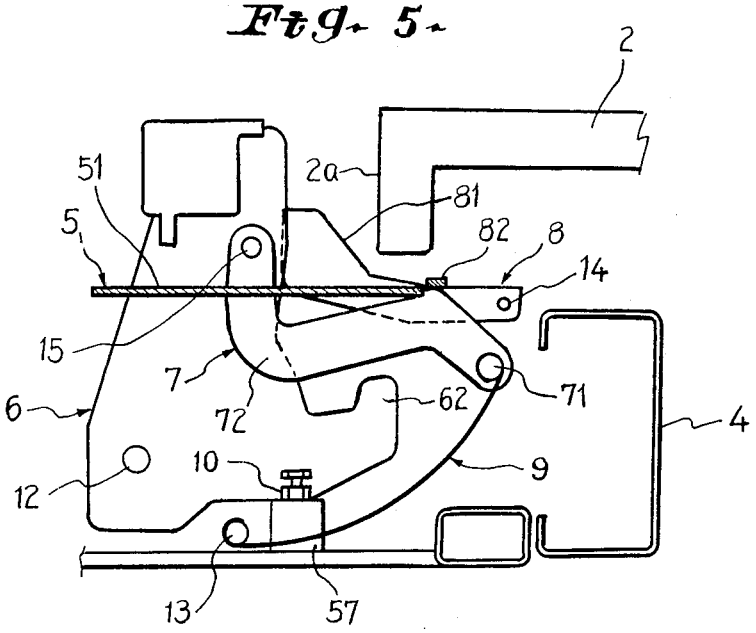
FIG. 5 is a schematic side view of the apparatus, particularly illustrating how the foot member is released from the locked state.
Figure 6:
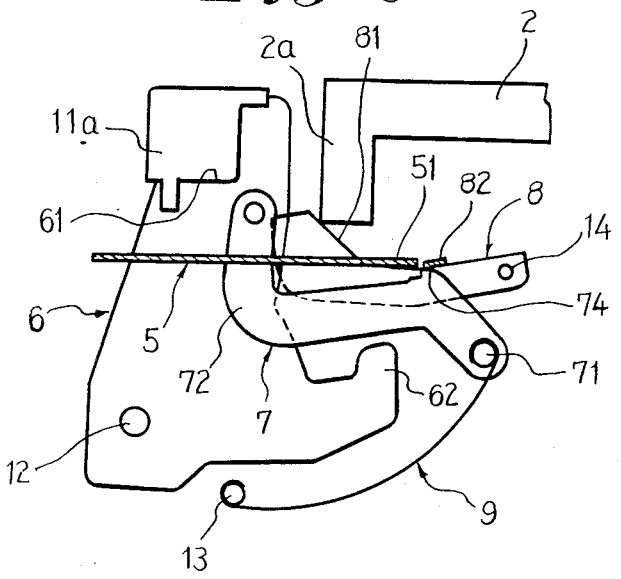

Two leaf springs 9 having the same configuration are disposed by both the sides of the stopper link 7 which has been housed in the frame 5 in that way in such a manner that their upper ends are pivotally engaged to the spring support rod 71 and their lower ends are pivotally engaged to pins 13 which are fixedly fitted into the holes 54. Owing to the arrangement of the leaf springs 9 made in this way two kinds of resilient forces will be exerted onto the spring support rod 71 under the following working conditions, wherein the pins 13 serve as a fulcrum for the leaf springs 9. It should be noted that the foot member 6 is equipped with a stopper 10 which projects downwardly of the bottom of the foot member 6 as illustrated in FIG. 5 and the stopper 10 has a predetermined length which can be adjusted by actuating bolt and nut. When the foot member 6 stands upright, the stopper 10 comes in abutment against the stopper reciever 57. Further, while the foot member 6 stands upright, the stepped portion 75 of the stopper link 75 are brought in engagement to the rear ends of the stopper pieces 51 of the frame 5 under the effect of resilient force of the leaf springs 9. At this moment the depressing plate 82 on the unlocking member 8 comes in contact with the raised portions 74 of the stopper link 7. Thus, the apparatus B is constituted by the above-described components which have been assembled in that way.

As illustrated in FIGS. 1 and 3 to 6, a plurality of apparatuses B are arranged on the movable platform 2 adjacent to the stanchions 4 at the same distance as that of the seats C and they are fixedly mounted on the movable platform 2 by means of bolts screwed into threaded holes 58 on the frames 5 whereby they move together with the movable platform 2. It should be noted that the housing 11 of the seat C is fixedly secured to the foot member 6 by bolting the joint member 11*a* of the housing 11 to the latter at the cutout portion 61 so that the seat C is turned up and down together with the foot member 6.

As will be apparent from FIG. 1, each of the apparatuses B is constructed such that as a certain movable platform 2 is displaced in the rightward direction as seen in the drawing to assume the retracted position, the foremost end of the next movable platform 2 located behind the first-mentioned one abuts against the folded seats on the first-mentioned platform 2 and thereby the seats are turned down when the first-mentioned movable platform 2 is displaced further, the folded seats C are laid below the last-mentioned movable platform 2 and the rearmost end of the first-mentioned platform 2 abuts against the stanchion of the last-mentioned movable platform 2 so that both the movable platforms 2 move together. Thus, all the seats C with the apparatuses B attached thereto are completely housed in the space as defined between both the adjacent movable platforms 2. Further, a downwardly projecting front nose 2*a* is fixedly secured to the foremost end of each of the adjacent upper movable platforms 2. When the telescopic seating system A is to be in use, the lowermost movable platform 2 is first drawn forwardly and the projections 62 on it collide against the front nose 2*a* of the adjacent upper movable platform 2, causing all the seats C on the first-mentioned platform 2 to stand upright. It should be noted that the housing 11 of each of the seats C is automatically folded in the flattened state with the aid of an actuating mechanism (not shown) as illustrated by real lines in FIG. 1 for the foremost movable platform when the telescoping seating system is to be stored. Thus, the folded housings of the seats C can be housed in the space as defined between the adjacent upper and lower movable platforms 2 as illustrated by phantom lines in the drawing. On the other hand, when the telescopic seating system is to be in use, the housings 11 of the seats C automatically unfolded from the flattened state so as to allow a spectator to sit on his seat, as illustrated by real lines in the drawing for the second and third movable platforms 2.

Next, operation of the apparatus for the telescopic seating system will be described below.

Figure 3:
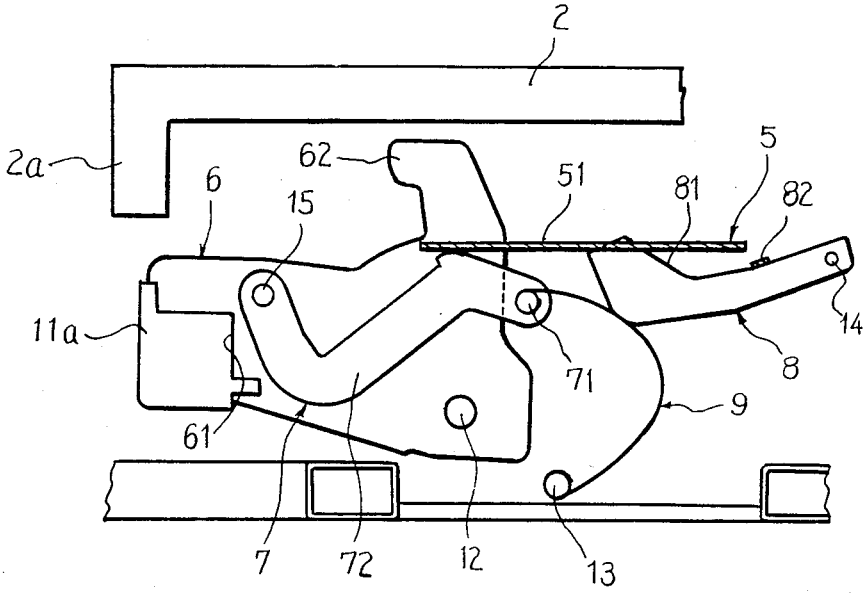
FIG. 3 is a schematic side view of the apparatus in accordance with an embodiment of the invention, shown in the stored state.
Figure 4:
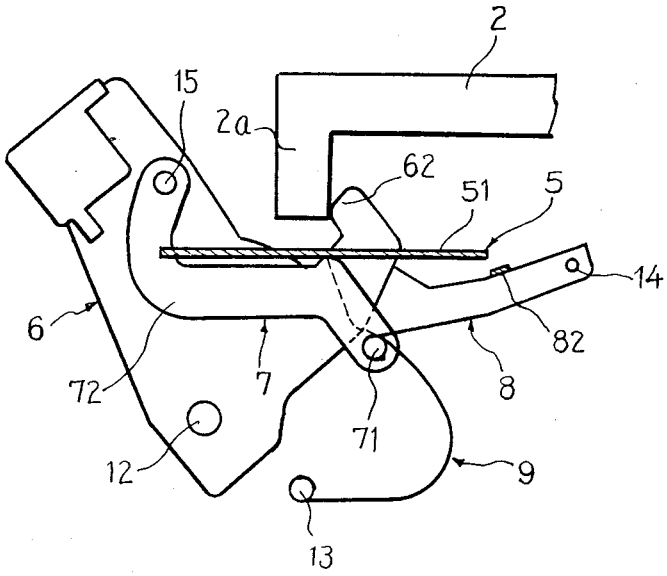
FIG. 4 is a schematic side view of the apparatus, particularly illustrating that the foot member is being turned up toward the upright standing posture under the effect of resilient force of the leaf spring.

When the telescopic seating system A is to be in use while assuming the extended position where the movable platforms are arranged in tiers, a base frame 1 with the platform 2 mounted thereon in each tier stage is caused to move forward with the aid of rollers 3 which are driven by an actuating mechanism (not shown). As the platform 2 is displaced in the leftward direction, all the seat C housed in the flattened state below the adjacent upper platform 2 are displaced also in the same direction together with the apparatus B as illustrated in FIG. 3. When the projections 62 located at the rear part of the foot member 6 abut against the front nose 2*a* of the adjacent upper platform 2, forward movement of the projections 62 is temporarily inhibited, as illustrated in FIG. 4. At this moment the frame 5 fixedly mounted on the platform 2 continues to move forward and therefore the foot member 6 held to turn about the support shaft 12 on the frame 5 is caused to gradually stand upright by turning movement about the support shaft 12. Since upright standing of the foot member 6 is positively assited by resilient force of the leaf springs 9, the seat C can automatically stand upright easily and reliably. It should of course be understood that all the seats C in each tier stage are caused to stand upright simultaneously.

When the apparatus B is displaced formwardly of the adjacent upper platform 2, the foot member 6 assumes the correct upright standing position as illustrated in FIG. 5 where the stopper 10 on the bottom of the foot member 6 comes in abutment against the stopper receiver 57 on the frame 5. At this moment both the stepped portions 75 on the stopper link 75 are engaged to the rear ends of the opposing pair of stopper pieces 51 on the frame 5 under the effect of resilient force of the leaf spring 9. Thus, the housing 11 of the seat C is kept in the upright standing state while it is completely locked.

On completion of operation of the telescopic seating system A all the movable platforms 2 are stored in the cavity of the building by way of the reverse steps to those as mentioned above without any occurrence of projection from the side wall surface of the building. To this end there is necessity for turning the seats C away from the upright standing state on each of the movable platforms 2 to lay down on the upper surface of the latter. This turning movement of the seats C will be described below with reference to FIGS. 5 and 6. As the movable platform 2 is displaced rearwardly, the apparatus B is displaced also in the same direction together with the movable platform 2. During rearward movement of the apparatus B the inclined surface 81 of the unlocking member 8 abuts against the front nose 2*a* of the adjacent upper platform 2. This causes the unlocking member 8 to gradually turn in the anticlockwise direction as seen in the drawings about the pin 14 which is located at the rear part of the unlocking member 8. As the unlocking member 8 turns in that way, the depressing plate 82 comes in contact with both the raised portion 74 of the stopper link 7 which is located just below the depressing plate 82 whereby both the stepped portions 75 which have been engaged to the stopper pieces 51 are displaced downwardly under the effect of depressing force given by the depressing plate 82 and they are then released from the engaged state. At this moment when the stopper link 7 has been disengaged from the frame 5, both the raised portions 74 of the stopper link 7 are brought in contact with the bottom surfaces of the opposing pair of stopper pieces 51 of the frame 5, causing resilient force of the leaf spring 9 to be exerted on the support rod 71 with the raised portions 74 serving as a fulcrum for the stopper link 7. Thus, as the platform 2 is displaced further rearwardly, the foot member 6 which is operatively connected to the stopper link 7 via the projection pieces 72 and the pin 15 is caused to gradually turn in the anticlockwise direction as seen in the drawings about the support shaft 12 whereby the housing 11 of the seat C on the foot member 6 turns in the same direction together with the foot member 6. All the seats C in each of the tier stages can assume the horizontally extending inoperative position smoothly in the above-described manner.

Figure 7:
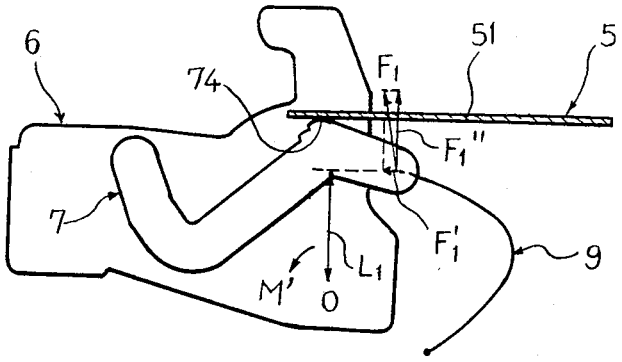
FIG. 7 is a fragmental schematic side view of the apparatus, particularly illustrating how a moment for turning down the foot member is generated with the aid of resilient force of the leaf spring with a moment caused by dead wieght of the foot member added thereto.

Next, description will be made below as to function of the leaf spring 9 in the course of turning-up and turning-down movement of the seats C with reference to FIGS. 7 and 8. It is assumed that reaction force of the leaf spring 9 which appears while the foot member 6 is kept in the stored state is represented by $F_1$ as illustrated in FIG. 7. As is apparent from the drawing, $F_1$ is divided into two components, that is, horizontally oriented component $F_1'$ and vertically oriented component $F_1''$. In the illustrated state the stopper link 7 is affected by vertical force which is represented by the vertically oriented component $F_1''$ while the raised portions 74 of the stopper link 7 are engaged to the stopper pieces 51 of the frame 5. Thus, the vertically oriented component $F_1''$ does not function as force by means of which the foot member 6 is caused to turn about the center 0 of rotation of the support shaft 12. On the other hand, when it is assumed that a distance as measured from the center 0 of rotation of the foot member 6 to the working line of the horizontally oriented component $F_1'$ is represented by $L_1$, a moment of $+F_1' \cdot L_1$ about the center 0 of rotation of the foot member 6 is generated by the horizontally oriented component $F_1'$ (in this case a moment active in the anticlockwise direction is identified by +mark). Since a moment of $+M'$ about the center 0 of rotation of the foot member 6 is additionally generated under the influence of dead weight of the foot member 6, a total moment $M_1$ about the center 0 of rotation of the foot member 6 is represented as follows.

$$M_1 = +F_1' \cdot L_1 + M'$$

Since the horizontally oriented component $F_1'$ derived from reaction force of the leaf spring 9 generates a moment which is effective in the direction of turning-down of the foot member 6, it is assured that the seat C is stably kept in the turned-down state.

Figure 8:
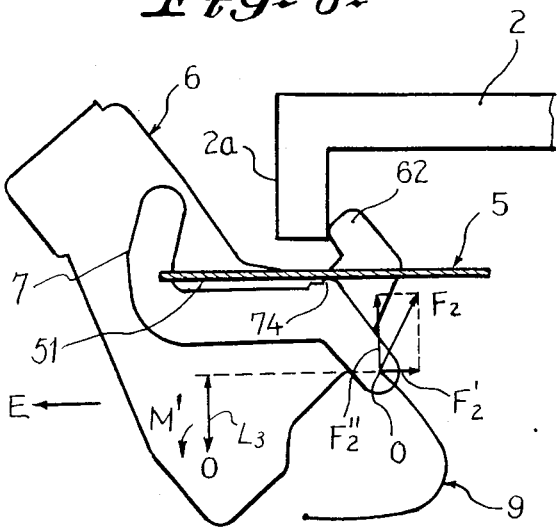
FIG. 8 is a fragmental schematic side view of the apparatus, particularly illustrating how a moment for turning up the foot member is generated with the aid of resilient force of the leaf spring against a moment caused by dead weight of the foot member.

Next, FIG. 8 illustrates that the leaf spring 9 assumes the neutral operative position. As the foot member 6 is displaced forwardly in the direction as identified by an arrow mark E, the projections 62 of the foot member 6 come in abutment against the front nose of the adjacent upper platform 2. This causes the foot member 6 to start turning movement about the center 0 of rotation of the latter in the direction of turning-up of the seat. It is now assumed that reaction force of the leaf spring 0 at the neutral operative position is represented by $F_2$. This reaction force $F_2$ is divided into two components, that is, horizontally oriented component $F_2'$ and vertically oriented component $F_2''$. Since the raised portion 74 of the stopper frame 7 are engaged to the stopper pieces 51 of the frame 5 under the effect of the vertically oriented component $F_2''$, the latter does not function as a moment about the center 0 of rotation of the foot member 6. When it is assumed that a distance as measured from the center 0 of rotation of the foot member 6 to the working line of the component $F_2'$ is represented by $L_2$, a moment of $-F_2' \cdot L_2$ about the center 0 of rotation of the foot member 6 is generated by the horizontally oriented component $F_1'$. Thus, the total moment $M_2$ about the center 0 of rotation of the foot member 6 is represented as follows.

$$M_2 = -F_2' \cdot L_2 + M'$$

where E' designates a moment which is generated by dead weight of the foot member 6. When the leaf spring 9 is located at the neutral operative position, the total moment $M_2$ becomes zero, that is, $M_2 = 0$. Accordingly, the following relation is established.

$$F_2' \cdot L = M'$$

Even when the leaf spring 9 moves past the neutral operative position, the foot member 6 continues to turn up toward the upright standing posture under the effect of moment derived from the horizontally oriented component $F_2'$ regardless of the fact that the projection 62 of the foot member 6 are disengaged from the front nose 2*a* of the adjacent upper platform 2. To sum up, before the neutral operative position is reached, the foot member 6 is caused to turn up due to abutment of the projections 62 of the foot member 6 against the front nose 2*a* of the adjacent upper platform 2, and after the leaf spring 9 moves past the neutral operative position, it continues to turn up toward the upright standing posture without any interruption under the effect of reaction force of the leaf spring 9.

As will be readily understood from the above description, the apparatus of the invention assures that turning-up movement before operation of the telescopic seating system and turning-down movement after completion of the same are easily and quickly achieved with remarkable saving of man-hours because turning-up and -down of all seats are automatically carried out in operative association with a movable platform on each of the tier stages which is adapted to move forward and backward. Therefore, the telescopic seating system can be operated at a reduced cost and moreover a building such as gymnasium or the like in which the telescopic seating system is installed can be used very economically.

While the present invention has been described above only with respect to a single preferred embodiment thereof, it should of course be understood that it should not be limited only to this but various changes or modifications may be made in any acceptable manner without departure from the spirit and scope of the invention as defined by the appended claims.

What is claimed is:

1. An apparatus for turning up and down seats for a telescopic seating system of the type including a plurality of movable platforms which are arranged in tiers essentially comprising;

a frame having a foot member and an unlocking member turnably carried thereon, said frame including an opposing pair of stopper pieces which have a slot formed therebetween so as to allow said foot member to be turnably held therein, said foot member being formed with projections at the rear end thereof which are adapted to abut against a front nose fixedly secured to the adjacent upper movable platform, a stopper link of which one end is pivotally connected to the foot member and of which other end is operatively connected to spring means, said stopper link being formed with raised portions adapted to be engaged to the rear ends of the stopper pieces of the frame, said spring means being operatively connected to the stopper link at the upper end thereof and having resiliency which is effective for turning up the foot member toward the upright standing posture when the projections of the foot member are disengaged from the front nose of the adjacent upper movable platform, and said unlocking member including an inclined surface and a depressing plate, said inclined surface being adapted to abut against the front nose of the adjacent upper movable platform and said depressing plate serving to depress the stepped portions of the stopper link.

2. An apparatus as defined in claim 1, wherein the frame is fixedly mounted on a movable platform and its rear side is fixedly secured to a stanchion which stands upright on the movable platform.

3. An apparatus as defined in claim 1, wherein the frame has a stopper receiver fixedly secured to the bottom thereof and a stopper on the bottom of the foot member abuts against said stopper receiver when the foot member assumes the upright standing position.

4. An apparatus as defined in claim 1, wherein the foot member is formed with a cutout at which a housing of the seat is fixedly connected to the foot member.

5. An apparatus as defined in claim 1, wherein the projections on the foot member abut against the front nose of the adjacent upper movable platform when the first-mentioned movable platform is displaced in the forward direction to assume the extended position.

6. An apparatus as defined in claim 1, wherein the inclined surface of the unlocking member abuts against the front nose of the adjacent upper movable platform when the first-mentioned movable platform is displaced in the backward direction to assume the retracted position.

7. An apparatus as defined in claim 1, wherein the resilient means is preferably designed in the form of a leaf spring and functions such that before it assumes the neutral operative position a moment is generated which is effective for turning down the foot member with a moment due to dead weight of the latter added thereto and after the neutral operative position is reached a moment is generated which is effected for turning up the foot member against the moment due to dead weight of the latter.

8. An apparatus as defined in claim 1, wherein the foot member is kept in the locked state while the stepped portions of the stopper link are engaged to the rear ends of the stopper pieces of the frame.

9. An apparatus as defined in claim 1, wherein the foot member is released from the locked state when the depressing plate of the unlocking member depresses the raised portions of the stopper link.

* * * * *